US008833679B2

(12) United States Patent
Bryant et al.

(10) Patent No.: US 8,833,679 B2
(45) Date of Patent: Sep. 16, 2014

(54) ELECTROSTATIC SPRAY SYSTEM WITH GROUNDING TEETH

(75) Inventors: Jessica Rose Bryant, Toledo, OH (US); James P. Baltz, Waterville, OH (US)

(73) Assignee: Finishing Brands Holdings, Inc., Minneapolis, MN (US)

( * ) Notice: Subject to any disclaimer, the term of this patent is extended or adjusted under 35 U.S.C. 154(b) by 697 days.

(21) Appl. No.: 12/954,525

(22) Filed: Nov. 24, 2010

(65) Prior Publication Data

US 2012/0126042 A1 May 24, 2012

(51) Int. Cl.

| | |
|---|---|
| ***B05B 7/32*** | (2006.01) |
| ***B05B 5/053*** | (2006.01) |
| ***B65D 83/20*** | (2006.01) |
| ***B65D 83/38*** | (2006.01) |
| *B05B 5/16* | (2006.01) |

(52) U.S. Cl.

CPC ..... *B65D 83/384* (2013.01); *B05B 5/1691* (2013.01); *B05B 5/0531* (2013.01); *B65D 83/202* (2013.01)

USPC ..... 239/708; 239/337; 239/526

(58) Field of Classification Search

USPC ..... 239/289, 329–333, 337–339, 526, 708

See application file for complete search history.

(56) References Cited

U.S. PATENT DOCUMENTS

| | | | | |
|---|---|---|---|---|
| 4,004,733 | A | | 1/1977 | Law |
| 4,248,386 | A | | 2/1981 | Morle |
| 4,356,528 | A | | 10/1982 | Coffee |
| 4,381,533 | A | | 4/1983 | Coffee |
| 4,476,515 | A | | 10/1984 | Coffee |
| 4,577,803 | A | | 3/1986 | Owen |
| 4,971,257 | A | * | 11/1990 | Birge ..... 239/708 |
| 5,222,663 | A | | 6/1993 | Noakes et al. |
| 5,320,291 | A | * | 6/1994 | Glover et al. ..... 239/708 |
| 5,400,975 | A | | 3/1995 | Inculet et al. |
| 5,531,384 | A | | 7/1996 | Greene et al. |
| 5,582,875 | A | | 12/1996 | Ryosuke |
| 5,630,793 | A | | 5/1997 | Rowe |
| 5,904,273 | A | | 5/1999 | Aspacher et al. |
| 5,932,011 | A | | 8/1999 | Noakes et al. |

(Continued)

FOREIGN PATENT DOCUMENTS

| | | |
|---|---|---|
| EP | 0118202 | 12/1984 |
| JP | 63077562 | 7/1988 |

(Continued)

OTHER PUBLICATIONS

International Search Report for application No. PCT/US2011/062037 mailed Feb. 21, 2012.

(Continued)

*Primary Examiner* — Christopher Kim

(74) *Attorney, Agent, or Firm* — Fletcher Yoder, P.C.

(57) ABSTRACT

A system, in certain embodiments, includes a spray device having a frame with a receptacle configured to receive a self-contained spray can, a trigger assembly disposed within the frame and configured to selectively engage a spray of fluid from a spray nozzle of the self-contained spray can, a grounding system having a first conductive element configured to contact the self-contained spray can, and an electrostatic charge system coupled to the grounding system. The first conductive element includes a first tooth configured to extend at least partially into an exterior surface of the self-contained spray can.

12 Claims, 9 Drawing Sheets

(56) References Cited

U.S. PATENT DOCUMENTS

| | | | | |
|---|---|---|---|---|
| 6,079,634 | A | 6/2000 | Noakes et al. | |
| 6,199,766 | B1 | 3/2001 | Fox et al. | |
| 6,216,966 | B1 | 4/2001 | Prendergast et al. | |
| 6,279,834 | B1 | 8/2001 | Fox et al. | |
| 6,311,903 | B1 | 11/2001 | Gaw et al. | |
| 6,318,647 | B1 | 11/2001 | Gaw et al. | |
| 6,326,062 | B1 | 12/2001 | Noakes et al. | |
| 6,482,357 | B1 | 11/2002 | Fox et al. | |
| 6,592,813 | B1 | 7/2003 | Fox et al. | |
| 6,612,510 | B1 | 9/2003 | Fox et al. | |
| 6,682,004 | B2 | 1/2004 | Kadlubowski et al. | |
| 6,814,318 | B2 | 11/2004 | Wilson et al. | |
| 7,150,412 | B2 | 12/2006 | Wang et al. | |
| 7,152,817 | B2 | 12/2006 | Wilson et al. | |
| 7,393,385 | B1 | 7/2008 | Coffey et al. | |
| 7,460,924 | B2 | 12/2008 | Alexander et al. | |
| 7,815,132 | B2 | 10/2010 | Baltz | |
| 7,905,430 | B1 * | 3/2011 | Kumar | 239/337 |
| 8,025,508 | B2 * | 9/2011 | Parker et al. | 439/92 |
| 2007/0194157 | A1 | 8/2007 | Golden et al. | |
| 2008/0202413 | A1 | 8/2008 | Seitz et al. | |
| 2010/0072309 | A1 | 3/2010 | Hodge et al. | |
| 2010/0176224 | A1 | 7/2010 | Hasselschwert et al. | |
| 2011/0210192 | A1 | 9/2011 | Seitz et al. | |

FOREIGN PATENT DOCUMENTS

| | | |
|---|---|---|
| WO | WO2008074455 | 6/2008 |
| WO | WO2008074462 | 6/2008 |
| WO | 2011106518 | 1/2011 |

OTHER PUBLICATIONS

Written Opinion for application No. PCT/US2011/062037 mailed Feb. 21, 2012.

U.S. Appl. No. 12/638,681, filed Dec. 15, 2009, Hasselschwert et al.

U.S. Appl. No. 12/714,280, filed Feb. 26, 2010, Seitz et al.

* cited by examiner

ELECTROSTATIC SPRAY SYSTEM WITH GROUNDING TEETH

FIELD OF THE INVENTION

The invention relates generally to an electrostatic spray system and, more specifically, to a system for electrostatically transferring a charge to a spray emitted from an aerosol can.

BACKGROUND

Known aerosol spray coating systems often have a low transfer efficiency. In other words, a large portion of the sprayed coating material does not actually coat the target object. For example, when a metal fence is sprayed with an aerosol spray paint can, only a small portion of the paint actually coats the target fence, thereby wasting a large portion of the paint. Further, known aerosol spray systems may apply uneven coatings to a target object, causing an undesirable finish.

A need exists for spray coating systems which provide enhanced transfer efficiency.

SUMMARY

Various embodiments of the present disclosure provide a spray coating system which includes a spray device having a frame with a receptacle configured to receive a self-contained spray can, a trigger assembly disposed within the frame and configured to selectively engage a spray of fluid from a spray nozzle of the self-contained spray can, a grounding system with a first conductive element configured to contact the self-contained spray can, and an electrostatic charge system coupled to the grounding system. The first conductive element may include a first tooth configured to extend at least partially into an exterior surface of the self-contained spray can.

In this manner, a self-contained spray can having an exterior surface may be placed within the spray device, and the first conductive element of the grounding system may establish a positive connection with the self-contained spray can. More particularly, the first tooth of the first conductive element may extend at least partially into the exterior surface and contact a metal surface of the self-contained spray can, creating an electrical connection between the self-contained spray can and an earth ground. The electrical connection between the self-contained spray can and the earth ground enables operation of the electrostatic charge system. The electrical connection also may automatically switch the electrostatic charge system into an activated state.

Other features and advantages of the present disclosure will be apparent from the following detailed disclosure, taken in conjunction with the accompanying sheets of drawings, wherein like numerals refer to like parts, elements, components, steps and processes.

DETAILED DESCRIPTION

Figure 1:
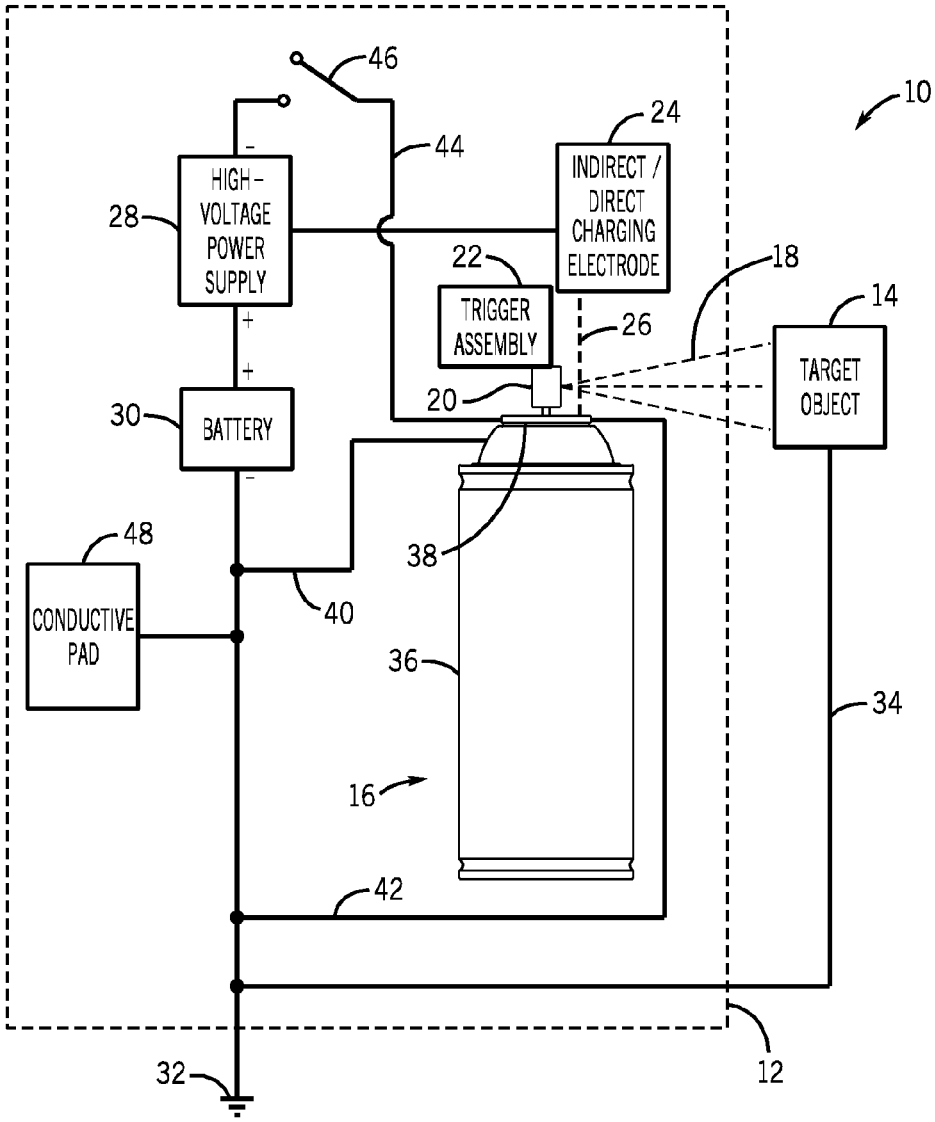
FIG. 1 is a diagram illustrating a spray coating system in accordance with one embodiment of the present disclosure.

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements. Any examples of operating parameters and/or environmental conditions are not exclusive of other parameters/conditions of the disclosed embodiments.

Various embodiments of the present disclosure provide enhanced transfer efficiency of fluid sprayed from a self-contained spray can by electrostatically charging the spray of fluid. In certain embodiments, the spray device includes an electrostatic charging system with a grounding system, which includes one or more grounding teeth configured to extend partially into an exterior surface (e.g., an insulative layer) of the self-contained spray can. For example, each grounding tooth may be biased toward the exterior surface along a top portion (e.g., neck, lip, or upper surface) of the self-contained spray can. Each grounding tooth may have a sharp edge or semi-sharp edge to enable the tooth to extend completely through any insulative layer on the self-contained spray can, thereby ensuring positive contact with the metal wall of the self-contained spray can. For example, certain embodiments of the grounding teeth include annular shaped grounding teeth. In certain embodiments, the electrostatic charging of the fluid of the spray device may be achieved with an indirect charging system or a direct charging system. In the direct charging system, the fluid passes over a charged electrode and accepts a negative charge. The fluid is then atomized after receiving the charge by the charged electrode. In the indirect charging system, the fluid is atomized and then the individual fluid particles pass through an ion field, thereby causing each fluid particle to obtain a negative charge. Although the disclosed grounding teeth may be used in either a direct or indirect charging system, the following discussion presents the grounding teeth in context of an indirect charging system.

Referring now to FIG. 1, an exemplary spray coating system 10 including a spray device 12 for applying a desired coating to a target object 14 in accordance with an embodiment of the present disclosure is shown. In the illustrated embodiment, the spray device 12 includes a self-contained spray can 16 configured to provide a spray of fluid 18 toward the target object 14. As will be appreciated, the self-contained spray can 16 may include a liquid, such as paint, and a pressurized gas or propellant. As illustrated, the spray can 16 includes a spray nozzle 20 having a valve assembly which seals the liquid and propellant within the spray can 16. When the spray nozzle 20 is depressed, the valve opens, thereby facilitating a flow of liquid through the spray nozzle 20. The pressure exerted by the propellant on the liquid, causes the liquid to break up into droplets as the liquid exits the spray nozzle 20, thereby forming an aerosol or spray of fluid 18. As droplets impact the target object 14, the target object 14 is coated with the liquid. In certain embodiments, the liquid is a paint which forms a coating on the target object 14 as the paint dries.

The illustrated spray device 12 includes a trigger assembly 22 configured to selectively engage the spray of fluid 18 from the spray nozzle 20 of the self-contained spray can 16. As discussed in detail below, the trigger assembly 22 includes an actuating arm which depresses the spray nozzle 20 when a trigger is engaged, thereby inducing the spray of fluid 18 toward the target object 14. In addition, the spray device 12 includes a direct or indirect charging device, such as the illustrated charging electrode 24, configured to electrostatically charge the spray of fluid 18 from the spray nozzle 20. As will be appreciated, charging the spray of fluid 18 imparts an electrostatic charge on the fluid droplets. Consequently, the droplets will be electrostatically attracted to an electrically grounded object, such as the target object 14, thereby increasing the transfer efficiency between the fluid and the target object 14. In one embodiment, the spray coating system 10 includes a direct charging system, which utilizes a direct charging electrode 24. In the direct charging system, as the fluid passes over the charged electrode 24, the fluid directly accepts a negative charge. The fluid is then atomized after receiving the charge by the charged electrode 24. In another embodiment, the spray coating system 10 includes an indirect charging system, which utilizes an indirect charging electrode 24. In the indirect charging system, the fluid is atomized and then the individual fluid particles pass through an ion field, thereby causing each fluid particle to obtain a negative charge. Thus, embodiments of the system 10 may employ a variety of indirect or direct charging devices (e.g., electromagnetic transducers) to impart an electrostatic charge of the fluid droplets. Although the system 10 may employ either a direct or indirect charging system, the following discussion presents a grounding system with grounding teeth in context of an indirect charging system.

Indirect charging devices may not directly contact the spray of fluid 18. Because an indirect charging device may be positioned outside of the flow path of the fluid droplets, the device may remain substantially free of fluid build-up, thereby enabling a substantially continuous charge to be applied to the spray of fluid 18. In contrast, direct electrostatic charging systems may place an electrode in the path of the fluid droplets to electrostatically charge the droplets via contact with the electrode. For example, an embodiment of the direct electrostatic charging system may integrate the charging electrode 24 with the spray nozzle 20, or the electrode 24 may be separate from the spray nozzle 20.

As illustrated, the charging electrode 24 is electrically coupled to a high-voltage power supply 28 which supplies a high-voltage signal to the electrode 24. For example, in certain embodiments, the high-voltage power supply 28 may provide more than approximately 5 k, 7.5 k, 9 k, 10.5 k, 15 k, 20 k, 25 k, 30 k, 35 k volts, or more to the charging electrode 24. While a high-voltage signal is provided, a relatively small electrical current may be sufficient to impart the desired charge on the fluid droplets. For example, in certain embodiments, the high-voltage power supply 28 may be configured to output less than approximately 100, 80, 60, 50, 40, 30, or less micro-Amperes. As illustrated, a positive terminal of a battery 30 is electrically coupled to a positive terminal of the high-voltage power supply 28. Based on the desired power output from the high-voltage power supply 28, a commercially available battery (e.g., 9V, 12V, etc.) may be employed to provide electrical power to the high-voltage power supply 28. In various alternative embodiments, a standard or proprietary rechargeable battery may be employed.

In the illustrated embodiment, the negative terminal of the battery 30 is electrically coupled to an earth ground 32. As will be appreciated, the earth ground is not a chassis ground or floating ground, but rather a direct or indirect connection to the earth. Consequently, the potential of the earth ground 32 will be substantially equal to the potential of the earth. For example, a suitable earth ground 32 may be established by driving a conductive stake into soil. In such a configuration, an electrical charge flowing into the stake will be dissipated through the soil. Alternatively, the earth ground 32 may include an electrical connection to a conductive water pipe or main having a subterranean portion. The subterranean portion of the conductive pipe serves to dissipate an electrical charge into the soil in a similar manner to the stake described above. The earth ground 32 may also include an electrical connection to a building ground (e.g., the ground plug of an electrical outlet).

As illustrated, an electrical conductor 34 extends between the target object 14 and the earth ground 32. Consequently, the potential of the target object 14 will be substantially equal to the potential of the earth ground 32. As a result, the potential difference or voltage between the electrostatically charged fluid droplets and the target object 14 may be greater than configurations in which the target object 14 is connected to a chassis ground of the spray device 12. For example, if the potential of the chassis of the spray device 12 is greater than the potential of the earth, the potential difference between the charged fluid droplets and the target object 14 will be reduced. Because the present embodiment electrically couples the target object 14 to the earth ground 32, the transfer efficiency of the fluid spray 18 may be enhanced due to the increased potential difference.

In addition, the self-contained spray can 16 is electrically coupled to the earth ground 32. As illustrated, the spray can 16 includes a body 36 and a neck 38. As will be appreciated, the body 36 and neck 38 may be composed of a conductive material, such as aluminum or steel. However, certain spray cans 16 include a seal between the body 36 and neck 38 composed of an electrically insulative material (e.g., plastic). Consequently, the neck 38 may be electrically insulated from the body 36. Therefore, to ensure that the entire self-contained spray can 16 is grounded, the body 36 and neck 38 may be independently electrically coupled to the earth ground 32. In the present embodiment, an electrical conductor 40 extends between the body 36 of the spray can 16 and the earth ground 32, and an electrical conductor 42 extends between the neck 38 and the earth ground 32. As a result of this configuration, each portion of the spray can 16 is electrically grounded to the earth ground 32.

Electrically coupling the neck 38 of the self-contained spray can 16 to the earth ground 32 may establish a greater potential difference or voltage between the charging electrode 24 and the neck 38 compared to embodiments in which the neck 38 is coupled to a chassis ground of the spray device 12. As previously discussed, if the potential of the chassis of the spray device 12 is greater than the potential of the earth, the potential difference between the charging electrode 24 and the neck 38 of the spray can 16 will be reduced. In an embodiment employing an indirect charging system, the chassis of the spray device 12 may not be able to fully dissipate the charge induced by the stream of ions from the charging electrode 24 (e.g., corona-charging electrode). As a result, the potential difference between the electrode 24 and the neck 38 may decrease over time, thereby further reducing the potential difference or voltage applied to the spray of fluid 18. In contrast, because the present embodiment electrically couples the neck 38 to the earth ground 32, a steep electrical gradient (e.g., large voltage differential over a small distance) may be maintained between the charging electrode 24 and the spray can 16, thereby increasing the electrical charge on the fluid droplets and enhancing the transfer efficiency with the target object 14.

As previously discussed, the body 36 of the self-contained spray can 16 is also grounded to the earth ground 32. During operation of the spray device 12, the electrostatically charged fluid droplets may contact the body 36 of the spray can 16. Because the body 36 is grounded, a charge induced by the fluid droplets will be transferred to the earth ground 32, and dissipated. As a result, the potential of the spray can 16 may remain substantially equal to the potential of the earth ground 32, thereby substantially reducing or eliminating the possibility of establishing a voltage between the body 36 of the spray can 16 and an object at the ground potential.

As illustrated, a second electrical conductor 44 is coupled to the neck 38 of the spray can 16. The electrical conductor 44 extends between the neck 38 and a negative terminal of the high-voltage power supply 28. As will be appreciated, the high-voltage power supply 28 will not activate until both a positive and negative electrical connection is established with the battery 30. In the illustrated embodiment, the negative electrical connection with the battery 30 includes the electrical conductor 44, the neck 38 of the self-contained spray can 16 and the electrical conductor 42. As a result, the negative electrical connection between the high-voltage power supply 28 and the battery 30 will be interrupted if the spray can 16 is removed from the spray device 12. Consequently, the high-voltage power supply 28 will not activate unless the spray can 16 is present within the spray device 12 and the electrical conductors 42 and 44 are in contact with the neck 38 of the spray can 16. This configuration substantially reduces or eliminates the possibility of accidental contact with a live circuit during insertion or removal of the self-contained spray can 16.

In the illustrated embodiment, the electrical conductor 44 includes a switch 46 configured to selectively activate the charging electrode 24. Similar to the can presence assembly described above, the switch 46 will block current flow to the high-voltage power supply 28 while in the illustrated open position, and facilitate current flow to the high-voltage power supply 28 while in the closed position. It should be appreciated that in alternative embodiments the switch 46 may be positioned between the positive terminal of the battery 30 and the positive terminal of the high-voltage power supply 28. In the illustrated embodiment, the switch 46 is positioned adjacent to the trigger assembly 22 such that depression of the trigger closes the switch 46. In this manner, the spray of fluid 18 is initiated at substantially the same time as activation of the charging electrode 24.

The spray device 12 also includes a conductive pad 48 coupled to the earth ground 32. As discussed in detail below, the conductive pad 48 may be attached to a handle of the spray device 12 such that an operator hand makes contact with the pad 48 while grasping the spray device 12. Because the conductive pad 48 is electrically connected to the earth ground 32, the potential of the operator will be substantially equal to the earth potential while the operator is grasping the spray device 12. Such a configuration substantially reduces or eliminates the possibility of a potential difference being established between the operator and a component of the spray device 12.

Figure 2:
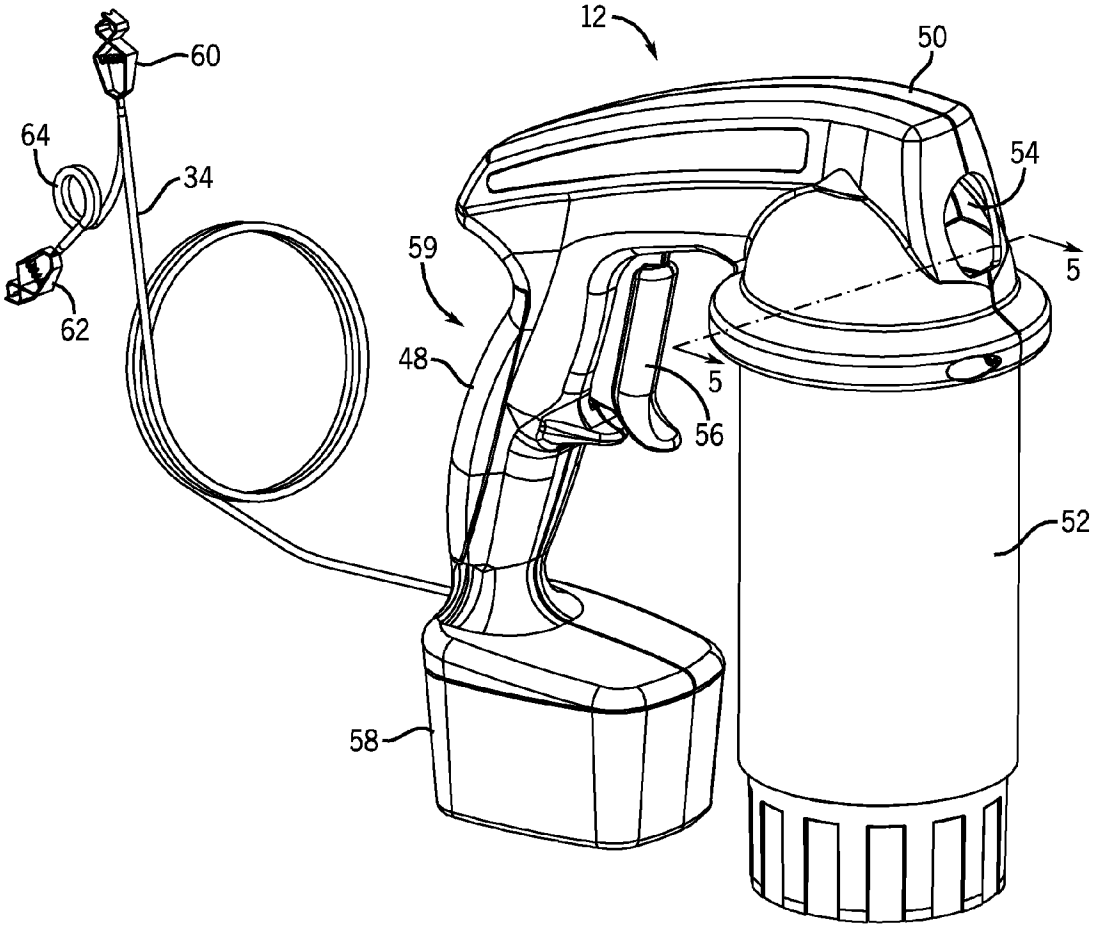
FIG. 2 is a perspective view of an exemplary embodiment of a spray device for use in the spray coating system illustrated in FIG. 1.

Referring now to FIG. 2, an exemplary spray device for use in the spray coating system 10 of FIG. 1 is shown. As illustrated, the spray device 12 includes a frame 50 and a removable spray can housing 52. As discussed in detail below, the spray can housing 52 is configured to contain and properly position the self-contained spray can 16 within the spray device 12. To couple the spray can 16 to the spray device 12, the spray can housing 52 may be uncoupled from the frame 50, the spray can 16 may be inserted into the housing 52, and the housing 52 may be coupled to the frame 50. Once the spray can 16 is coupled to the spray device 12, the fluid spray 18 expelled from the nozzle 20 may be directed through the opening 54 within the frame 50. For example, an operator may depress the trigger 56, thereby inducing the trigger assembly 22 to activate the nozzle 20 of the self-contained spray can 16. As previously discussed, the trigger assembly 22 may be coupled to the electrostatic activation switch 46 such that depressing the trigger 56 activates the charging electrode 24. In this manner, depressing the trigger 56 induces the spray of electrostatically charged fluid 18 to be expelled from the opening 54 toward the target object 14.

The spray device 18 also includes a power module 58 coupled to a handle portion 59 of the frame 50. In certain embodiments, the power module 58 contains the battery 30 and the high-voltage power supply 28. The power module 58 may be removable such that the battery 30 may be replaced. The handle portion 59 also includes the conductive pad 48 configured to contact an operator hand during operation of the spray device 12. Because the conductive pad 48 is located in the handle portion 59, the operator will contact the pad 48 while grasping the handle 59. Consequently, the operator will be electrically coupled to the earth ground 32, thereby substantially reducing or eliminating the possibility of establishing a potential difference between the operator and a portion of the spray device 12.

As previously discussed, the target object 14 may be coupled to the earth ground 32 by an electrical conductor 34. In the illustrated embodiment, the electrical conductor 34 extends from the spray device 12 to a first spring clip 60, and from the first spring clip 60 to a second spring clip 62 via an electrical conductor 64. The first spring clip 60 may be coupled to the target object 14 and the second spring clip 62 may be coupled to the earth ground 32. As previously discussed, the earth ground 32 may include an electrical connection to a building ground, to a water pipe and/or to a conductive stake disposed within soil. Coupling between the earth ground 32 and the target object 14 via the conductor 64 may ensure that the potential of the target object 14 is substantially equal to the earth potential. In addition, the conductor 34 may be electrically coupled to the conductive pad 48, the neck 38 of the spray can 16, the body 36 of the spray can 16 and the negative terminal of the battery 30 via electrical conductors disposed within the spray device 12.

Figure 3:
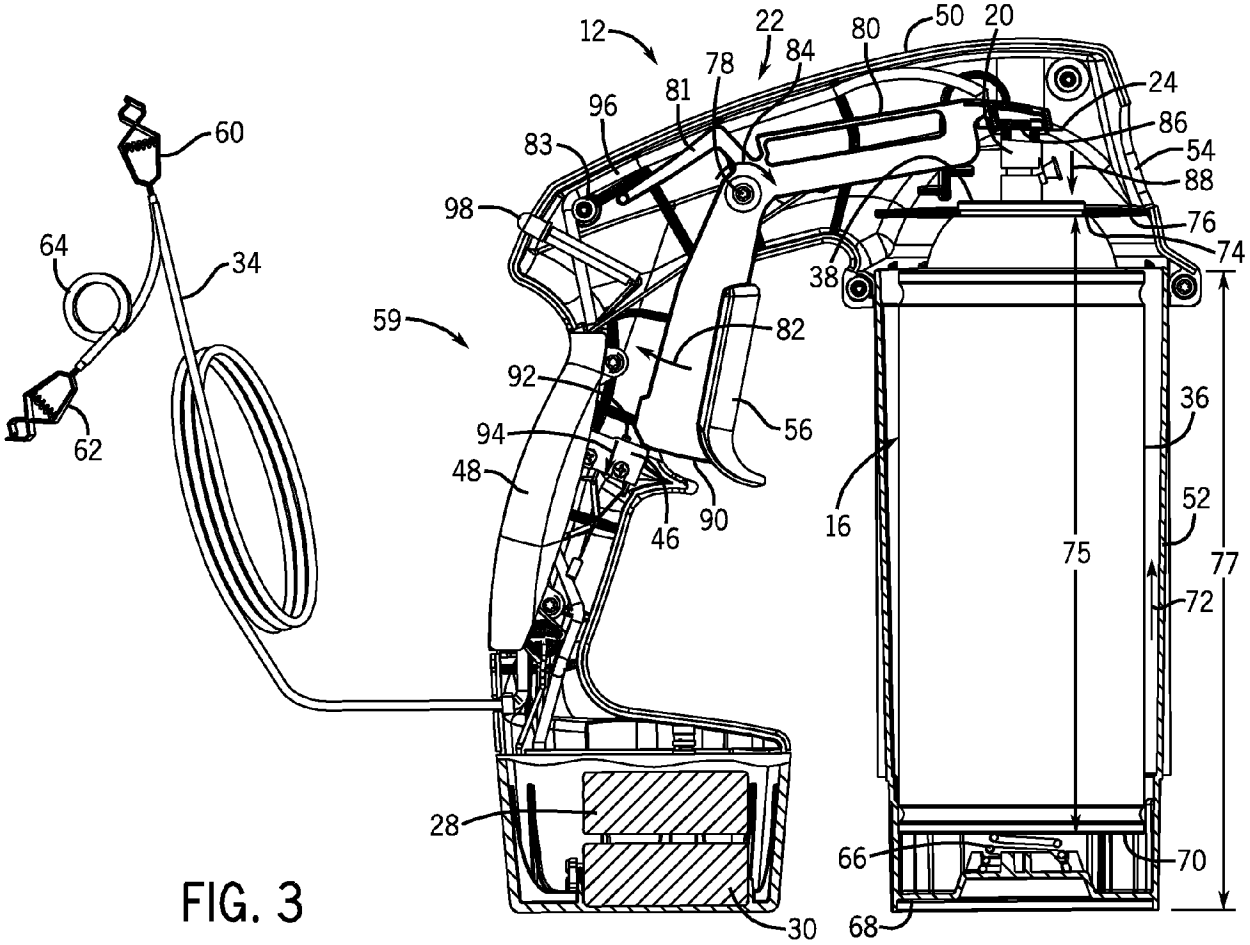
FIG. 3 is a side view of the spray device, as shown in FIG. 2, with a side panel removed to expose a trigger assembly.

Referring now to FIG. 3, the example spray device 12 of FIG. 2 is shown with a side panel removed to expose the trigger assembly 22. FIG. 3 also includes a cross-sectional view of the spray can housing 52, exposing the self-contained spray can 16. As illustrated, a spring 66 extends between a bottom surface 68 of the spray can housing 52 and a bottom surface 70 of the spray can 16. The spring 66 biases the spray can 16 in an upward direction 72 to ensure contact with conductive tabs (e.g., 108, 110, 116, and 160) to maintain a ground between the spray can 16 and the earth ground 32, as discussed in detail below with reference to FIGS. 5, 6, and 9-17. For example, the spring force may be an amount or factor greater than the combined force of the frame 50 acting downward on the spray can 16 and an actuation force to depress the nozzle 20. Thus, as a user operates the spray device 12 (e.g., actuation of nozzle 20), the spring 66 maintains contact between the spray can 16 and the earth ground 32 via the conductive tabs.

As will be appreciated, a length 75 between the top surface 74 and the bottom surface 70 may vary between spray cans 16. For example, different manufacturers may produce spray cans 16 having different lengths 75. Consequently, a length 77 of the spray can housing 52 may be particularly selected to accommodate a variety of spray can lengths 75. In addition, the spring 66 may expand or contract based on the length 75 of the spray can 16, while providing the upward bias to maintain contact between the upper surface 74 of the spray can 16 and the retaining ring 76. In this manner, the spray nozzle 20 may be appropriately positioned for spray device operation despite variations in the length 75 of the spray cans 16.

As previously discussed, the trigger assembly 22 may actuate the spray nozzle 20 of the self-contained spray can 16 to initiate the spray of fluid 18 from the nozzle 20. In the illustrated embodiment, the trigger assembly 22 includes the trigger 56, a pivot 78 and an actuating arm 80. As illustrated, the pivot 78 is pivotally coupled to the frame 50 such that the trigger assembly 22 may rotate about the pivot 78. The trigger assembly 22 also includes a biasing member 81 in contact with a protrusion 83 of the frame 50. To initiate the spray of fluid 18, the trigger 56 may be depressed in a direction 82, thereby driving the trigger assembly 22 to rotate about the pivot 78 in a direction 84. As the trigger assembly 22 rotates, contact between the biasing member 81 and the protrusion 83 induces the biasing member 81 to flex, thereby providing resistance to rotation. In addition, rotation of the trigger assembly 22 induces a contact surface 86 of the distal end of the actuating arm 80 to translate in the direction 88. Because the contact surface 86 is positioned adjacent to the spray nozzle 20, movement of the contact surface 86 in the direction 88 drives the spray nozzle 20 toward the neck 38 of the spray can 16, thereby initiating the spray of fluid 18.

In the present configuration, the trigger assembly 22 is configured to activate the charging electrode 24 at substantially the same time as the spray of fluid 18 is initiated. Specifically, the trigger 56 includes a bottom portion 90 positioned adjacent to the electrostatic activation switch 46. As the trigger 56 is depressed in the direction 82, the bottom portion 90 of the trigger 56 contacts a spring-loaded protrusion 92, and drives the protrusion 92 in the direction 94, thereby closing the switch. As previously discussed, closing the switch 46 establishes an electrical connection between the battery 30 and the high-voltage power supply 28, thereby activating the charging electrode 24. Consequently, depressing the trigger 56 will produce a spray of electrostatically charged fluid droplets from the opening 54 in the frame 50 of the spray device 12. As will be appreciated, alternative embodiments may include a switch 46 positioned adjacent to other regions (e.g., actuating arm 80, pivot 78, etc.) of the trigger assembly 22 such that depressing the trigger 56 drives the switch 46 to the closed position. In further embodiments, the switch 46 may be operated independently of the trigger 56 such that an operator may initiate the spray of fluid 18 without activating the electrostatic charging system.

As illustrated, a conduit 96 extends between the high-voltage power supply 28 and the charging electrode 24. The conduit 96 is disposed about the electrical conductor which powers the electrode 24. As will be appreciated, electrical conductors carrying a high-voltage signal may interfere with surrounding electronic devices and/or induce a charge within adjacent conductors or circuits. Consequently, the conduit 96 is configured to shield surrounding devices, conductors and/or circuits from the high-voltage signal passing through the charging electrode supply conductor. The present embodiment also includes an indictor, such as the illustrated light emitting diode (LED) 98, which visually depicts the operational state of the electrostatic charging system. As discussed in detail below, the LED 98 is electrically coupled to the battery 30, and configured to illuminate upon activation of the charging electrode 24. Consequently, an operator may readily determine whether the spray of fluid 18 is being electrostatically charged by the spray device 12.

Figure 4:
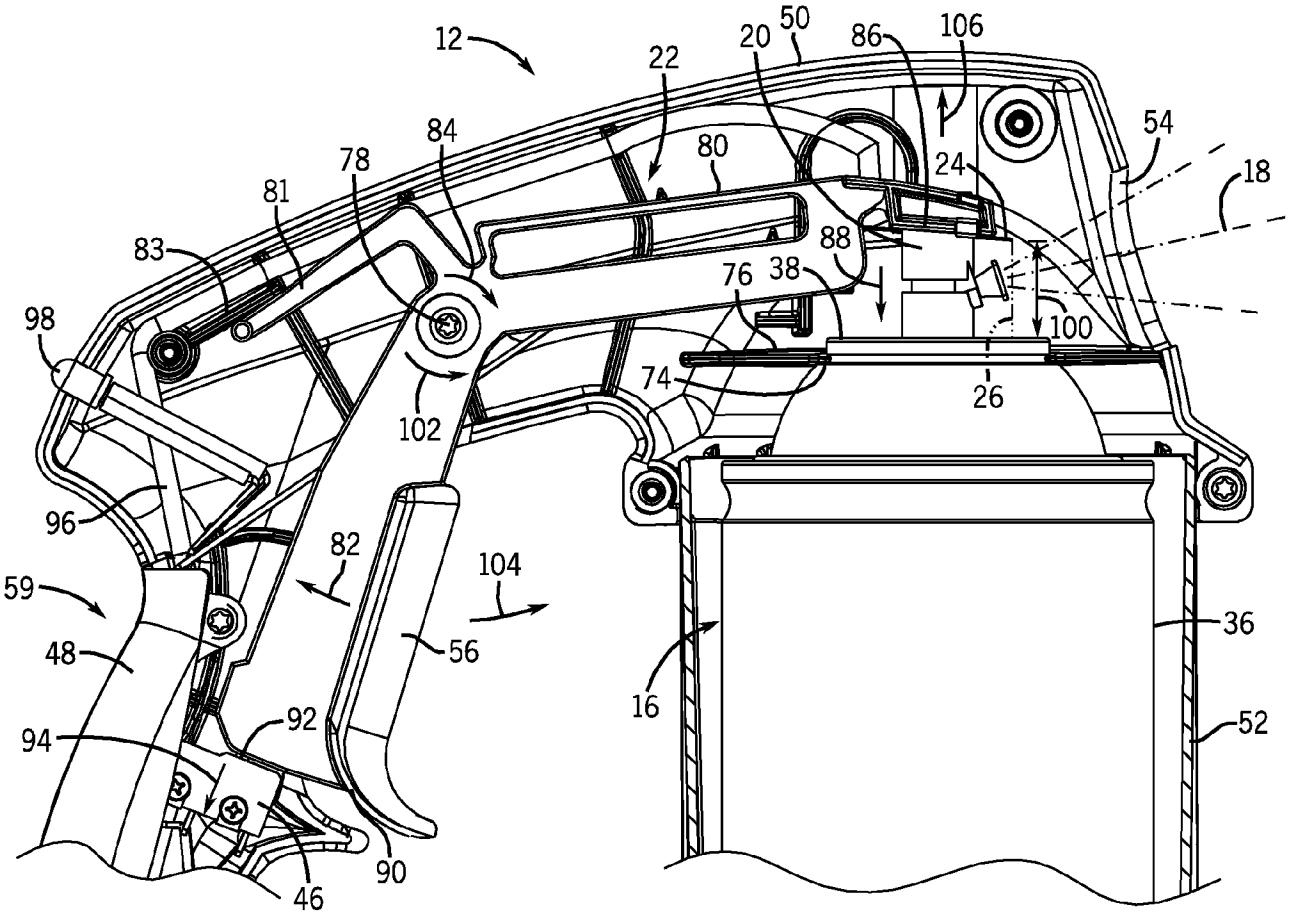
FIG. 4 is a side view of the spray device, as shown in FIG. 3, in which the trigger assembly is rotated to initiate a spray of fluid from a self-contained spray can.

Referring now to FIG. 4, the trigger assembly 22 is rotated to initiate the spray of fluid 18 from the self-contained spray can 16. As illustrated, translation of the trigger 56 in the direction 82 has induced the trigger assembly 22 to rotate about the pivot 78 in the direction 84, thereby inducing the biasing member 81 to flex. In addition, contact between the contact surface 86 of the actuating arm 80 and the spray nozzle 20 has driven the nozzle 20 in the direction 88 from the position illustrated in FIG. 3, thereby initiating the spray of fluid 18. As previously discussed, the size and shape of the opening 54 is particularly configured to accommodate the spray of fluid 18 such that substantially all fluid droplets pass through the opening 54.

Furthermore, translation of the trigger 56 in the direction 82 has driven the protrusion 92 of the switch 46 in the direction 94, thereby closing the switch 46 and activating the charging electrode 24. As illustrated, the charging electrode 24 is positioned a distance 100 from the neck 38 of the spray can 16. In the present embodiment, the distance 100 is approximately 0.5 inches. However, it should be appreciated that alternative embodiments may position the electrode 24 closer or farther from the neck 38. For example, the distance 100 may be greater or less than approximately 0.1, 0.2, 0.3, 0.4, 0.5, 0.6, 0.7, 0.8, 0.9, 1.0 inches in further embodiments. As previously discussed, the neck 38 of the spray can 16 is electrically coupled to the earth ground 32. In an embodiment having an indirect charging system, when the charging electrode 24 is activated, a large potential difference or voltage (e.g., 10.5 kV) will be established between the electrode 24 and the neck 38, thereby generating the stream of negatively charged ions 26. As the spray of fluid 18 passes through the ion stream 26, the fluid droplets become electrostatically charged. Due to the large potential difference between the electrode 24 and the neck 38 (e.g., 10.5 kV) and the short separation distance 100 (e.g., 0.5 inches), a steep potential gradient may be established. As will be appreciated, the steep potential gradient may serve to impart an electrical charge on the fluid droplets more efficiently than embodiments which employ a larger separation distance and/or do not ground the neck 38 of the spray can 16 to the earth ground 32. As a result of the increased electrical charge, the transfer efficiency of the fluid spray 18 may be enhanced, thereby increasing fluid coverage of the target object 14.

In an embodiment having an indirect charging system, the charging electrode 24 includes a sharp point configured to concentrate a flow of electrons to induce the formation of the ion stream 26. As will be appreciated, the size and/or shape of the point may be particularly configured to establish desired properties of the ion stream 26. In one embodiment, the charging electrode 24 is composed of brass; however, it should be appreciated that, in alternative embodiments, other suitable materials may be employed. In an embodiment having an indirect charging system, because the charging electrode 24 is not in the flow path of the fluid droplets, the electrode 24 may remain substantially free of fluid build-up, thereby enabling a substantially continuous charge to be applied to the spray of fluid 18. While the ion stream 26 is illustrated as a broken line in FIG. 4, it should be appreciated that the stream of ions 26 may not be visible and/or may produce no visible phenomenon in an actual implementation.

As previously discussed, the spray device 12 includes the conductive pad 48 located in the handle portion 59 and configured to contact an operator hand during operation of the spray device 12. For example, as an operator grasps the handle 59 and depresses the trigger 56, the operator palm may contact the pad 48. Because the conductive pad 48 is electrically connected to the earth ground 32, the potential of the operator will be substantially equal to the earth potential while the operator is grasping the spray device 12. Such a configuration substantially reduces or eliminates the possibility of a potential difference being established between the operator and a component of the spray device 12.

To terminate the spray of fluid 18 and deactivate the charging electrode 24, the operator may release the trigger 56. Contact between the biasing member 81 and the protrusion 83 will then urge the trigger assembly 22 to rotate in the direction 102, thereby driving the trigger 56 in the direction 104 and the actuating arm 80 in the direction 106. As the actuating arm 80 translates in the direction 106, the contact surface 86 will be removed from the spray nozzle 20, thereby disengaging the spray of fluid 18. In addition, translation of the trigger 56 in the direction 104 will remove contact between the bottom portion 90 of the trigger 56 and the protrusion 92. As a result, the switch 46 will transition to the open position, thereby deactivating the electrostatic charging system.

Figures 5, 6:
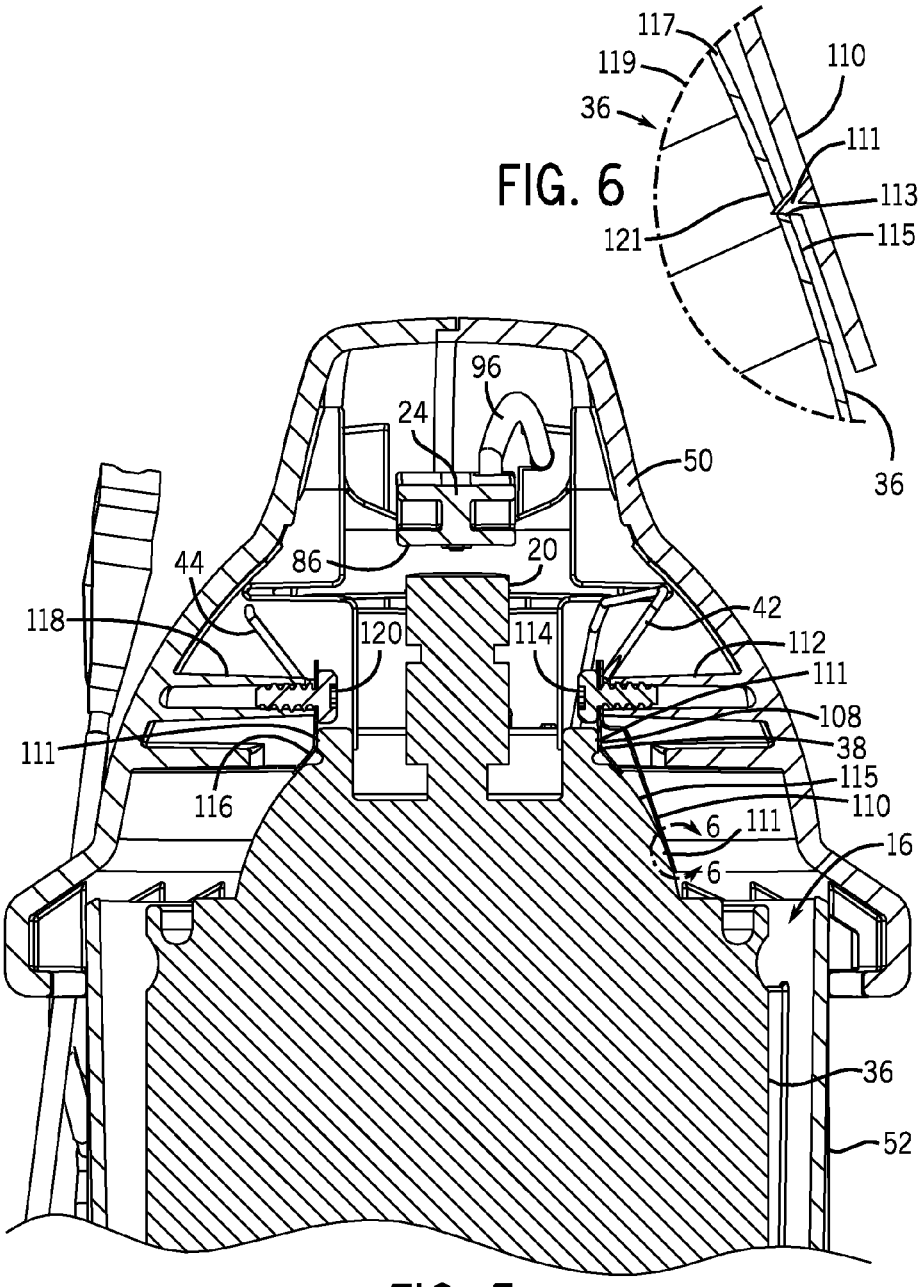
FIG. 5 is a cross-sectional view of the spray device, taken along line 5-5 of FIG. 2, illustrating the electrical contact between the spray device and the self-contained spray can.
FIG. 6 is a cross-sectional view of an example a conductive element of a grounding system, taken within line 6-6 of FIG. 5, illustrating a tooth of the conductive element piercing an exterior surface (e.g., insulative layer)

Referring now to FIG. 5, the electrical contact between the spray device 12, as shown in FIG. 2, and the self-contained spray can 16 is shown. As previously discussed, both the neck 38 and the body 36 of the self-contained spray can 16 are electrically coupled to the earth ground 32. Specifically, the electrical conductor 40 extends between the body 36 of the spray can 16 and the earth ground 32, and the electrical conductor 42 extends between the neck 38 and the earth ground 32. As illustrated, a first conductive element, such as the illustrated tab 108, contacts the neck 38 of the spray can 16, and a second conductive element, such as the illustrated tab 110, contacts the body 36. In the present embodiment, the conductive tabs 108 and 110 are flexible and biased toward the spray can 16. Consequently, as the self-contained spray can 16 is inserted into the frame 50 of the spray device 12, the first tab 108 contacts the neck 38 and the second tab 110 contacts the body 36, thereby providing an electrical connection between the spray can 16 and the conductors 40 and 42.

In the illustrated embodiment, the conductive tabs 108 and 110 each include one or more gripping protrusions, piercing members, or teeth 111 having sharp edges 113. The teeth 111 are configured to ensure positive contact with the self-contained spray can 16. For example, the sharp edges 113 of the teeth 111 are configured to extend into an exterior surface 115, completely through an insulative layer 117, to reach a metal wall 119 of the self-contained spray can 16. In certain embodiments, the sharp edges 113 may also extend partially into (i.e., without puncturing) a metal surface 121 of the metal wall 119 to ensure positive contact between the conductive tabs 108 and 110 and the self-contained spray can 16. Thus, the teeth 111 of the conductive tabs 108 and 110 ensure contact with the metal wall 119 despite any insulative layer 117 impeding an electrical ground. For example, the insulative layer 117 may include a protective coating, lacquer, or polymeric film disposed over the metal wall 119. By further example, the insulative layer 117 may include a label, such as an adhesive label, made out of plastic or paper. The insulative layer 117 also may include oils, paint, and other residue impeding a positive grounding contact with the metal wall 119. As discussed in further detail below, the teeth 111 extend completely through the insulative layer 117 and contact and/or extend partially into (i.e., without puncturing) the metal wall 119 of the self-contained spray can 16 as the can 16 is secured between the frame 50 and the spray can housing 52 of the spray device 12. For example, the teeth 111 may extend completely through the insulative layer 117 and make positive electrical contact with the metal wall 119 along the neck 38 or the body 36 of the self-contained spray can 16, thereby connecting the can 16 to the earth ground 32. In certain embodiments, the spray device 12 is configured to automatically switch the electrostatic charge system to an activated state based only on contact between the grounding system and the self-contained spray can 16, and the spray device 12 is configured to automatically switch the electrostatic charge system to a deactivated state based only on a lack of contact between the grounding system and the self-contained spray can 16. In other words, the spray device 12 may exclude a mechanical switch configured to activate or deactivate the electrostatic charge system based on the presence or absence of the spray can 16. Once activated, a user can operate the spray device 12 by pulling the trigger assembly 22.

In the illustrated embodiment, the first conductive tab 108 and the second conductive tab 110 are secured to a post 112 within the frame 50 by a fastener 114. As a result, the first tab 108 is in electrical contact with the second tab 110. Therefore, a single conductor 42 may electrically couple both tabs 108 and 110 to the earth ground 32. Such a configuration may be less expensive to produce than an embodiment employing a separate conductor for each tab 108 and 110.

As previously discussed, electrically coupling the neck 38 of the self-contained spray can 16 to the earth ground 32 may establish a greater potential difference or voltage between the charging electrode 24 and the neck 38 compared to embodiments in which the neck 38 is coupled to a chassis ground of the spray device 12. Consequently, a higher electrical charge may be applied to the fluid droplets, thereby enhancing the transfer efficiency with the target object 14. In addition, because the body 36 is grounded, a charge induced by the fluid droplets contacting the body 36 will be transferred to the earth ground 32, and dissipated. As a result, the potential of the spray can 16 may remain substantially equal to the potential of the earth ground 32, thereby substantially reducing or eliminating the possibility of establishing a voltage between the body 36 of the spray can 16 and an object at the ground potential.

As previously discussed, the high-voltage power supply 28 will not activate unless the spray can 16 is present within the spray device 12 and the electrical conductors 42 and 44 are in contact with the neck 38 of the spray can 16. This configuration substantially reduces or eliminates the possibility of accidental contact with a live circuit during insertion or removal of the self-contained spray can 16. To facilitate contact between the conductor 44 and the neck 38, the spray device 12 includes a third conductive element, such as the illustrated conductive tab 116, positioned on an opposite side of the self-contained spray can 16 from the tabs 108 and 110. Similar to the tabs 108 and 110, the third conductive tab 116 is flexible and biased toward the spray can 16. Additionally, the third conductive tab 116 has a tooth 111 with a sharp edge 113 configured to extend into the exterior surface 115, completely through the insulative layer 117. Consequently, as the self-contained spray can 16 is secured between the frame 50 and the housing 52 of the spray device 12, the tooth 111 protruding from the third tab 116 may extend into the exterior surface 115 and contact the neck 38, thereby providing an electrical connection between the spray can 16 and the electrical conductor 44. In the illustrated embodiment, the third conductive tab 116 is secured to a post 118 within the frame 50 by a fastener 120. In this configuration, the neck 38 of the spray can 16 will contact the teeth 111 on the tabs 108 and 116 when the spray can 16 is properly inserted into the frame 50, thereby establishing an electrical connection between the conductors 42 and 44, and facilitating operation of the electrostatic charging system.

Referring now to FIG. 6, the tooth 111 of the conductive tab 110 extending into the exterior surface 115 and extending at least partially through the insulative layer 117. In the illustrated embodiment, the tooth 111 has a tapered or wedge-shaped geometry leading to the sharp edge 113. For example, the tooth 111 may represent an elongated blade leading to the sharp edge 113, e.g., a knife edge. By further example, the tooth 111 may represent a conical shaft leading to a point. However, it should be appreciated that the geometry of the tooth 111 may vary in different embodiments. In operation, the sharp edge 113 extends into the exterior surface 115, extends completely through the insulative layer 117, and extends partially into (i.e., without puncturing) the metal wall 119 (e.g., the body 36 and/or neck 38). As a result, the tooth 111 ensures electrical contact with the metal wall 119 of the self-contained spray can 16, thereby electrically coupling the can 16 to the earth ground 32. As discussed in further detail below, the tooth 111 may comprise other geometries or configurations to facilitate the piercing of the exterior surface 115.

Figure 7:
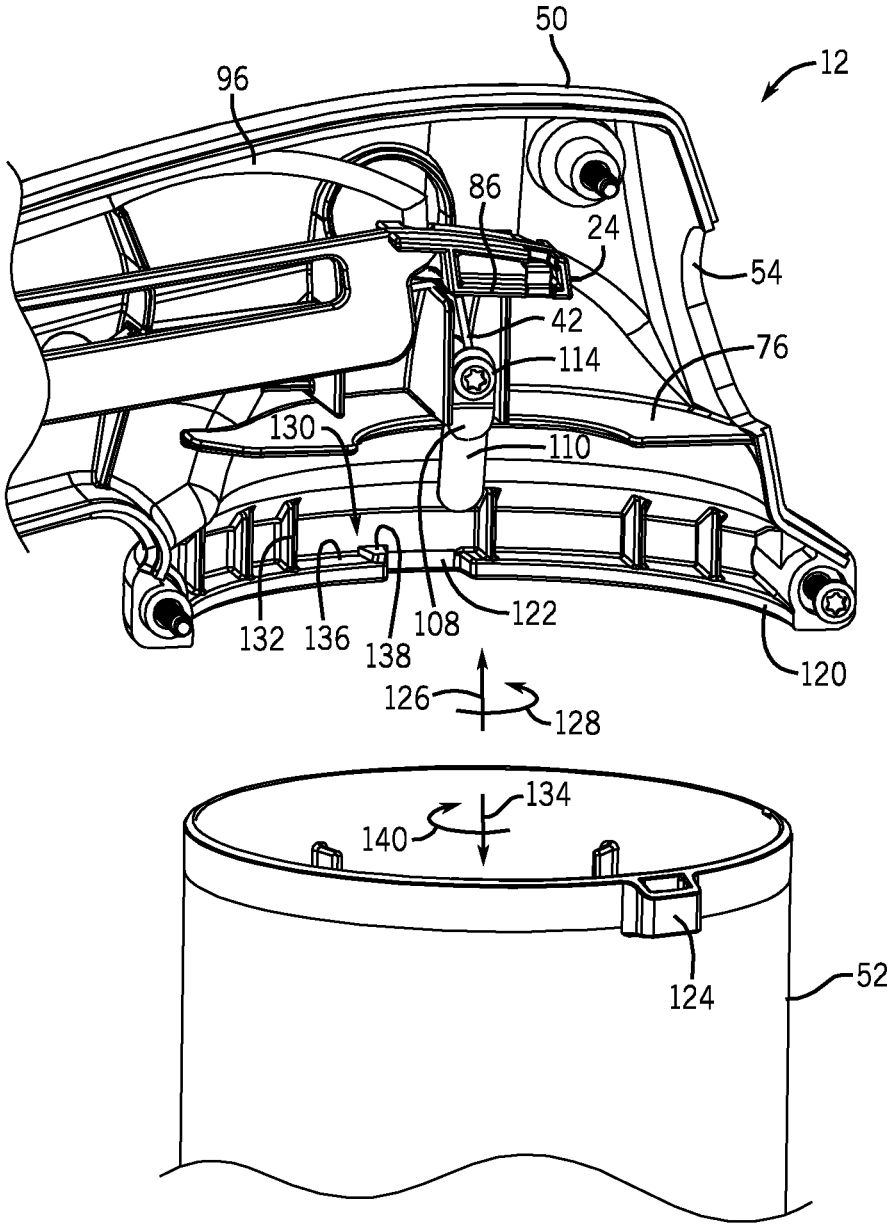
FIG. 7 is a perspective view of the spray device, as shown in FIG. 3, with the spray can housing detached from the spray device body.

Referring now to FIG. 7, the spray can housing 52 is shown detached from the spray device frame 50. As illustrated, the frame 50 includes a receptacle 120 configured to receive the self-contained spray can 16 and the spray can housing 52. In the illustrated embodiment, the receptacle 120 includes an opening 122 configured to receive a protrusion 124 of the housing 52. In this configuration, the housing 52 may be inserted into the receptacle 120 by aligning the protrusion 124 with the opening 122 and translating the housing 52 in an upward direction 126. While one opening 122 is shown, the illustrated embodiment includes a second opening on an opposite side of the receptacle. In addition, the spray can housing 52 includes a second protrusion 124 on the opposite side of the housing 52. While two protrusions 124 and openings 122 are employed in the present embodiment, it should be appreciated that alternative embodiments may include more or fewer protrusions 124 and openings 122. For example, certain embodiments may include 1, 2, 3, 4, 5, 6, 7, 8, or more protrusions 124 and openings 122. As will be appreciated, in such configurations, the protrusions 124 and openings 122 will be radially aligned to facilitate insertion of the housing 52 into the receptacle 120.

With the spray can 16 disposed within the housing 52, the top surface 74 of the spray can 16 will contact the retaining ring 76 before the protrusion 124 passes through the opening 122. As a result, the spray can 16 will compress the spring 66 during the housing insertion process, thereby inducing a resistance to motion in the upward direction 126. Consequently an operator will apply a force in the upward direction 126 to overcome the spring bias. Once the housing 52 has been inserted, the housing 52 may be rotated in a circumferential direction 128 to secure the housing 52 to the frame 50. In the illustrated embodiment, the frame 50 includes a cavity 130 configured to receive the protrusion 124. Rotation of the housing 52 in the direction 128 moves the protrusion 124 through the cavity 130 until the protrusion 124 contacts a stop 132. Next, the operator may release the upward force such that the spring 66 drives the housing 52 in a downward direction 134 until the protrusion contacts a lower rim 136 of the receptacle 120. As will be appreciated, the lower rim 136 blocks downward movement of the housing 52.

In the illustrated embodiment, the cavity 130 includes a shoulder 138 configured to block rotation of the housing 52 in a circumferential direction 140. In this manner, the cavity 130 blocks rotation of the housing in each circumferential direction 128 and 140, and blocks translation of the housing 52 in the downward direction 134. In alternative embodiments, the lower rim 136 may be elevated to the level of the shoulder 138 such that friction between the protrusion 124 and the lower rim 136 blocks rotation of the housing 52 in the direction 140. To remove the housing 52 from the frame 50, the operator may apply a force in the upward direction 126 against the spring bias. The upward force induces the protrusion 124 to translate in the upward direction 126 to a position non-adjacent to the shoulder 138. As a result, the housing 52 may be rotated in the circumferential direction 140 until the protrusion 124 aligns with the opening 122. The operator may then remove the housing 52 from the frame 50. Such a configuration may facilitate rapid insertion and removal of spray cans 16.

Figure 8:
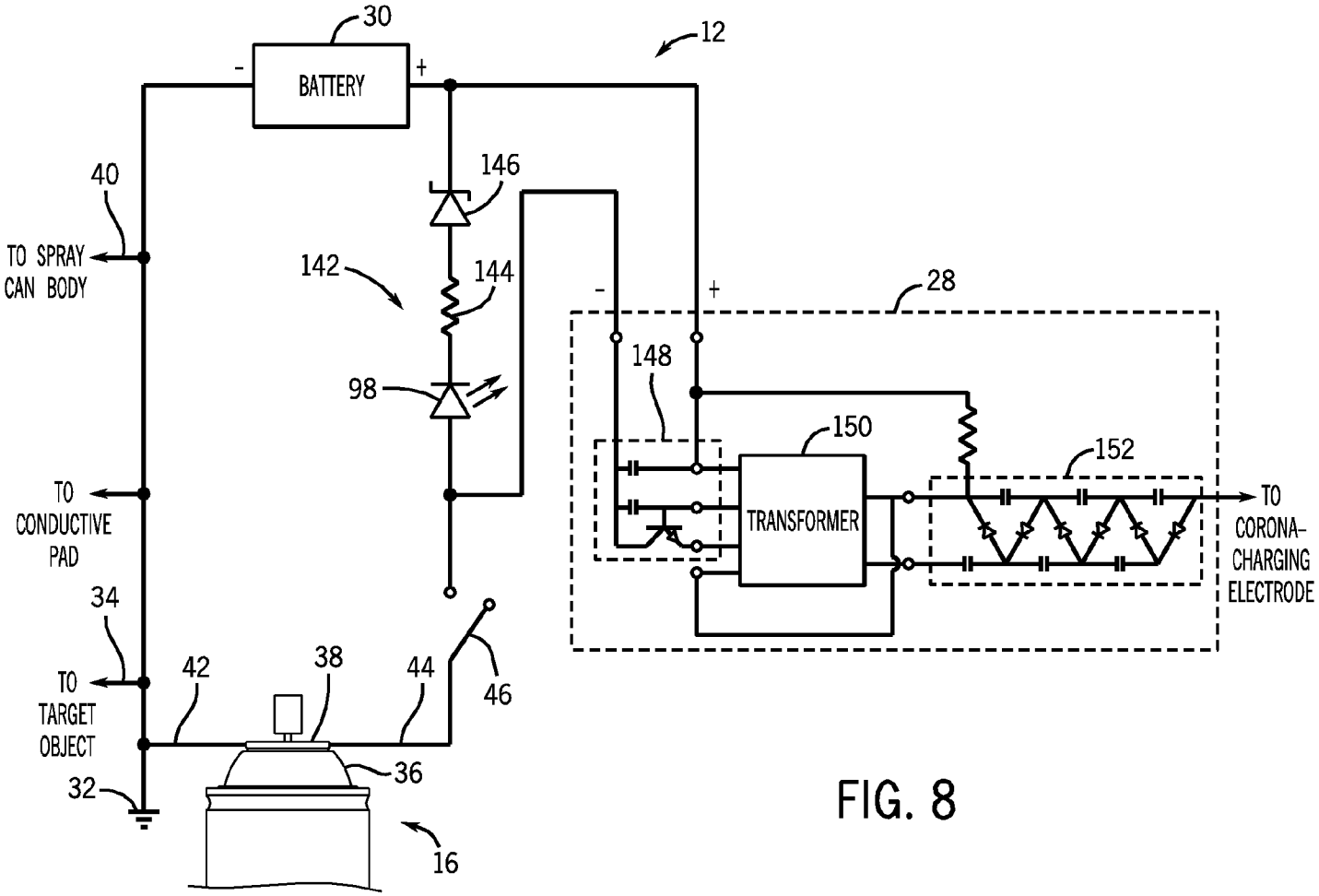
FIG. 8 is an exemplary circuit diagram of the spray device.

FIG. 8 is an exemplary circuit diagram of the spray device 12. As illustrated, an indicator circuit 142 is electrically coupled to the switch 46 and the positive terminal of the battery 30. The indicator circuit 42 is configured to both indicate operation of the electrostatic charging system and disable operation of the charging system if the battery voltage drops below a desired level. In the illustrated embodiment, the indicator circuit 142 includes the LED 98, a resistor 144 and a Zener diode 146. In this configuration, the LED 98 will illuminate when the electrostatic charging system is in operation. Specifically, when the neck 38 of the self-contained spray can 16 is positioned between the conductors 42 and 44, and the switch 46 is in a closed position, an electrical path is established between the negative terminal of the battery 30 and a first side of the LED 98. A second side of the LED 98 is electrically connected to the positive terminal of the battery 30 via the resistor 144 and the Zener diode 146. As will be appreciated, the resistor 144 serves to reduce the voltage to the LED 98 to a suitable level for LED operation. As a result of this configuration, the LED 98 will illuminate during operation of the electrostatic charging system, thereby providing an indication to an operator that the spray of fluid 18 is being charged.

The Zener diode 146 serves to block current flow to the high-voltage power supply 28 and the LED 98 if the battery voltage drops below a desired level. As will be appreciated, diodes are configured to block current flow in one direction. However, Zener diodes facilitate current flow in the blocked direction if the supplied voltage is greater than a specified level. Consequently, in the illustrated embodiment, the Zener diode 146 is configured to facilitate current flow to the LED 98 and high-voltage power supply 28 if the battery voltage is greater than an established value. For example, in certain embodiments, the battery 30 may be a commercially available 9V battery. In such a configuration, the high-voltage power supply 28 will be configured to increase the 9V input to a level suitable for electrostatically charging the spray of fluid 18 (e.g., 10.5 kV). Therefore, the Zener diode 146 may be configured to disable operation of the electrostatic charging system if the battery voltage drops below a level suitable for proper charging of the spray of fluid 18. For example, the Zener diode 146 may be configured to block current flow to the high-voltage power supply 28 and the LED 98 if the battery voltage drops below 8.5, 8, 7.5, 7, 6.5, 6 volts, or less. As will be appreciated, embodiments employing batteries having other voltages may utilize a Zener diode 146 having a different cut-off voltage. As a result of this configuration, illumination of the LED 98 indicates to the operator that the electrostatic charging system is activated and functioning within a desired voltage range.

As previously discussed, the high-voltage power supply 28 is configured to convert the voltage output by the battery 30 to a voltage suitable for operation of the charging electrode 24. In the illustrated embodiment, the high-voltage power supply 28 includes an inverter 148, a transformer 150 and a voltage multiplier 152. The inverter 148 is configured to convert the direct current (DC) from the battery 30 into an alternating current (AC) suitable for use by the transformer 150. In the illustrated embodiment, the inverter 148 includes a transistor and capacitors to generate a simulated AC signal from the input DC signal. However, it should be appreciated that other inverter configurations may be employed in alternative embodiments. The AC signal then enters the transformer 150 where the voltage is multiplied. As will be appreciated, the voltage output by the transformer 150 may be approximately equal to the input voltage multiplied by the ratio of secondary windings to primary windings.

As illustrated, the transformer 150 is electrically coupled to the voltage multiplier 152 which also may be known as a Cockcroft-Walton generator. As will be appreciated, each stage of the voltage multiplier 152 includes two capacitors and two diodes. Consequently, the illustrated embodiment employs a three-stage voltage multiplier 152. As will be further appreciated, the voltage output from the multiplier 152 is approximately equal to the input voltage times twice the number of stages. Therefore, the present voltage multiplier 152 is configured to output a voltage approximately equal to six times the input voltage. While a three-stage voltage multiplier 152 is utilized in the present embodiment, it should be appreciated that alternative multipliers may employ more or fewer stages. For example, certain voltage multipliers may include 1, 2, 3, 4, 5, 6, 7, 8, or more stages. By employing the voltage multiplier 152 to increase the voltage from the transformer 150, the overall size and weight of the high-voltage power supply 28 may be reduced compared to embodiments which only employ a transformer 150 to increase the voltage from the battery 30. While a Cockcroft-Walton voltage multiplier 152 is utilized in the present embodiment, it should be appreciated that alternative embodiments may employ other voltage multiplying circuits.

As previously discussed, the voltage output from the high-voltage power supply 28 may be approximately 10.5 kV in certain embodiments. Such a voltage may be suitable for use with the charging electrode 24. In an embodiment having an indirect charging system, the charging electrode 24 may be positioned outside of the flow path of the fluid spray 18, thereby substantially reducing or eliminating build-up of fluid on the electrode 24 and ensuring that the fluid droplets are sufficiently charged. Furthermore, because the spray can 16 is electrically coupled to the earth ground 32, a steep electrical gradient (e.g., large voltage over a small distance) may be maintained between the charging electrode 24 and the spray can 16, thereby increasing the electrostatic charge on the fluid droplets and enhancing transfer efficiency between the fluid spray 18 and the target object 14. In addition, because the body 36 is grounded, a charge induced by the fluid droplets contacting the spray can 16 will be transferred to the earth ground 32, and dissipated. As a result, the potential of the spray can 16 may remain substantially equal to the potential of the earth ground 32, thereby substantially reducing or eliminating the possibility of establishing a voltage between the body 36 of the spray can 16 and an object at the ground potential.

Figure 9:
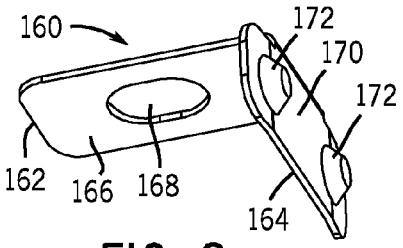
FIG. 9 is a perspective view of an exemplary embodiment of a conductive element of a grounding system of a spray device, illustrating first and second annular teeth.

Referring now to FIG. 9, an example embodiment of a conductive element 160 of a grounding system of the spray device 12 is shown. As discussed above, certain embodiments of the spray device 12 include conductive tabs (e.g., 108 and 110) configured to provide an electrical connection between the spray can 16 and the conductors 40 and 42. In the illustrated embodiment, one or more of the conductive elements 160 are configured to provide the electrical connection between the spray can 16 and the conductors 40 and 42. The conductive element 160 includes a mounting portion 162 and a tab portion 164. The mounting portion 162 includes a plate 166 with an aperture 168, while the tab portion 164 includes a plate 170 with a pair of teeth 172. As discussed in further detail below, the pair of teeth 172 is configured to make positive electrical contact with the self-contained spray can 16 to ensure proper grounding for electrostatically charging a spray from the can 16.

In the illustrated embodiment, the mounting portion 162 and the tab portion 164 are generally crosswise (e.g., perpendicular) to one another. For example, the plates 166 and 170 of the mounting and tab portions 162 and 164 may be a one-piece structure made from a single plate (e.g., sheet metal), which is bend approximately 90 degrees. By further example, the plates 166 and 170 of the mounting and tab portions 162 and 164 may be two separate pieces that are welded or otherwise coupled together to form the conductive element 160. In either embodiment, the conductive element 160 is made from an electrically conductive material, such as metal.

As discussed in further detail below, the aperture 168 in the plate 166 may receive a fastener, such as a screw, to secure the mounting portion 162 to the spray device 12. For example, a fastener 114 may pass through the aperture 168 into the post 112 of the frame 50, as discussed above with reference to FIG. 5. In other embodiments, the mounting portion 162 may include other mounts or couplings, such as a threaded stud, a latch, a friction fit, or a snap fitting.

The teeth 172 on the plate 170 are configured to extend partially into an exterior surface 115 of the self-contained spray can 16 to ensure electrical contact. In the illustrated embodiment, the plate 170 of the tab portion 164 includes two teeth 172 having an annular shape. In other embodiments, the plate 170 may include any number of teeth 172, such as 1 to 10 or more teeth 172. For example, the plate 170 may include one or more rows and columns of teeth 172 either spaced apart or in close proximity to one another. Although the illustrated teeth 172 have an annular shape, other embodiments of the teeth 172 may be rectangular, circular, triangular, wedge-shaped, or any other suitable geometry.

Figure 10:
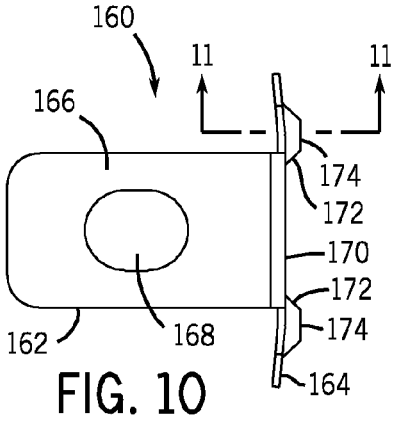
FIG. 10 is a side view of the conductive element, as shown in FIG. 9.

FIG. 10 illustrates a side view of an embodiment of the conductive element 160, as illustrated in FIG. 9. In the illustrated embodiment, the teeth 172 protrude outwardly from the plate 170 in a direction away from the plate 166. As the teeth 172 protrude outwardly from the plate 170, the teeth 172 taper or converge inwardly toward a sharp edge 174. For example, the teeth 172 may have a hollow conical shape or a hollow tapered cylindrical shape (e.g., a decreasing diameter), which leads to the sharp edge 174 (e.g., an annular sharp edge). Although the illustrated teeth 172 taper or converge toward the sharp edge 174, other embodiments of the teeth 172 may have a hollow cylindrical shape (e.g., a constant diameter) leading to the sharp edge 174 (e.g., an annular sharp edge). In either embodiment, the sharp edge 174 enables the teeth 172 to more readily extend into the exterior surface 115, completely through any insulative layer 117, of the metal wall 119 of the self-contained spray can 16.

Figure 11:
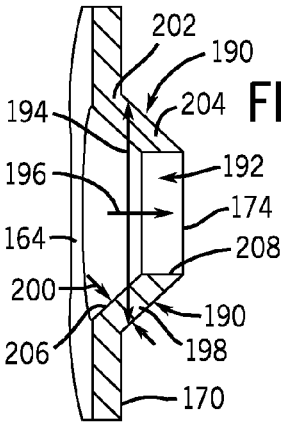
FIG. 11 is a partial cross-sectional side view of the conductive element, taken along line 11-11 of FIG. 10, illustrating a sharp annular edge of one of the annular teeth.

FIG. 11 is a partial cross-sectional side view of an embodiment of the conductive element 160, taken along line 11-11 of FIG. 10, illustrating a sharp annular edge 174 of one of the annular teeth 172. As discussed above, the tooth 172 protrudes outwardly from the tab portion 164 of the conductive element 160 in a converging or tapered manner. For example, the tooth 172 includes a hollow tapered portion 190 having a bore 192 leading to a sharp edge 174. In the illustrated embodiment, the hollow tapered portion 190 has a hollow conical shape, which decreases in diameter 194 in an outward direction 196 away from the plate 170. The hollow tapered portion 190 is defined by an annular wall 198 with a thickness 200. A first wall portion 202 of the annular wall 198 has a generally constant thickness 202 in the direction 196, while a second wall portion 204 of the annular wall 198 has a decreasing thickness 202 leading to the sharp edge 174. For example, the first wall portion 202 is disposed about a first bore portion 206 of the bore 192, while the second wall portion 204 is disposed about a second bore portion 208 of the bore 198. In the illustrated embodiment, the first bore portion 206 converges in the direction 196 to define a conical bore portion, while the second bore portion 208 is constant in the direction 196 to define a cylindrical bore portion. However, embodiments of the tooth 172 may have any suitable geometry of the sharp edge 174, the bore 192, and the wall 198.

Figure 12:
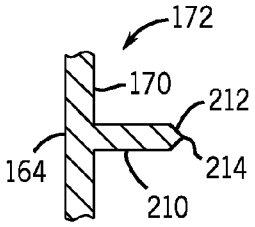
FIG. 12 is a partial cross-sectional side view of the conductive element, taken along line 11-11 of FIG. 10, illustrating a solid protrusion having a sharp tooth edge.

FIG. 12 is a partial cross-sectional side view of an embodiment of the conductive element 160, taken along line 11-11 of FIG. 10, illustrating a tooth 172 defined by a solid protrusion or shaft 210 having a tapered end 212 leading to a sharp tooth edge 214. In contrast to the embodiment of FIGS. 9-11, the tooth 172 of FIG. 12 is solid rather than hollow. For example, the solid protrusion 210 may be a solid cylindrical shaft, a solid rectangular shaft, a solid elongated blade, or another solid geometry. By further example, the tapered end 212 may be a conical shaped end, a wedge-shaped end, a pyramid shaped end, or another tapered end shape leading to the sharp tooth edge 214. As a result, the sharp tooth edge 214 may be a straight edge or a point edge, rather than an annular edge 174. In one embodiment, the solid protrusion 210 is a cylindrical shaft, while the tapered end 212 is a conical shaped edge or a wedge-shaped edge (e.g., two converging planar surfaces) leading to the sharp tooth edge 214. In another embodiment, the solid protrusion 210 is an elongated planar sheet, while the tapered end 212 is a wedge-shaped edge extending linearly along the elongated planar sheet to define a linear tooth edge 214. Regardless of the particular shape, the tooth 172 is configured to extend into the exterior surface 115, completely through any insulative layer 117, of the metal wall 119 of the self-contained spray can 16.

Figure 13:
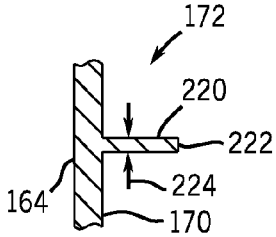
FIG. 13 is a partial cross-sectional side view of the conductive element, taken along line 11-11 of FIG. 10, illustrating a solid protrusion having a uniform thickness leading to a tooth edge.

FIG. 13 is a partial cross-sectional side view of an embodiment of the conductive element 160, taken along line 11-11 of FIG. 10, illustrating a tooth 172 with a solid protrusion 220 having a uniform thickness 224 leading to a tooth edge 222. As discussed above, the tooth 172 is configured to extend into the exterior surface 115, completely through any insulative layer 117, of the metal wall 119 of the self-contained spray can 16. In the illustrated embodiment, the solid protrusion 220 has a sufficiently small thickness 224 to enable penetration of the exterior surface 115, including any insulative layer 117, without a tapered edge. For example, the solid protrusion 220 may be a solid cylindrical shaft, a solid rectangular shaft, a solid planar sheet, or another solid geometry with a small thickness 224. In certain embodiments, the thickness 224 may be less than 1 millimeter.

Figure 14:
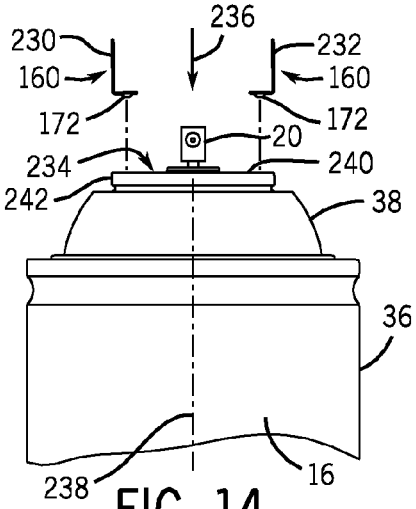
FIG. 14 is a schematic side view of an exemplary embodiment of a grounding system exploded from a self-contained spray can, illustrating first and second conductive elements with teeth approaching a top portion of the self-contained spray can.

FIG. 14 is a schematic side view of an embodiment of a grounding system exploded from a self-contained spray can 16, illustrating first and second conductive elements 160 (e.g., 230 and 232) with teeth 172 approaching a top portion 234 of the self-contained spray can 16. As illustrated, the first and second conductive elements 230 and 232 are biased toward the top portion 234 of the spray can 16 in a direction 236 along a longitudinal axis 238 of the spray can 16. Thus, in the illustrated embodiment, the teeth 172 of the conductive elements 230 and 232 are configured to approach, extend into, and make electrical contact with an upper axial surface 240 of the top portion 234. For example, the upper axial surface 240 may be disposed along an annular rim or lip 242, which encircles the spray nozzle 20. The biasing force in the direction 236 may be provided by the connection of the frame 50 with the housing 52, as discussed above. Thus, as the frame 50 and housing 52 axially compress the self-contained spray can 16, the teeth 172 are forced against the upper axial surface 240.

Figure 15:
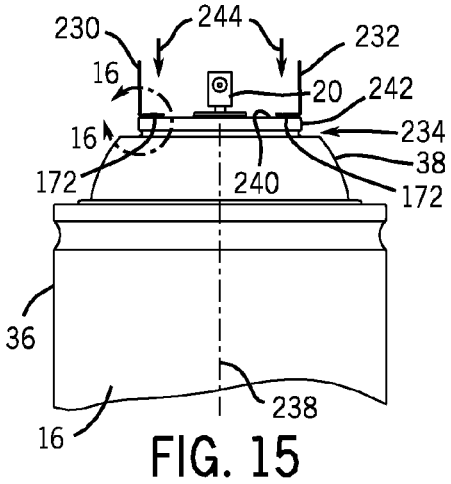
FIG. 15 is a schematic side view of the grounding system in contact with the self-contained spray can, as shown in FIG. 14, illustrating the teeth piercing an exterior surface (e.g., insulative layer) on the top portion.

FIG. 15 is a schematic side view of an embodiment of the grounding system in contact with the self-contained spray can 16, as shown in FIG. 14, illustrating the teeth 172 piercing the exterior surface 115 (e.g., insulative layer 117) on the top portion 234. In the illustrated embodiment, the conductive elements 230 and 232 are disposed on opposite sides of the spray nozzle 20 in contact with the upper axial surface 240 of the top portion 234. In particular, the teeth 172 are biased against the upper axial surface 240 with a biasing force 244, which causes the teeth 172 to make positive contact with the metal wall 119 of the spray can 16. For example, as noted above, the biasing force 244 may be generated as the frame 50 and housing 52 are secured together about the spray can 16. Furthermore, a spring may be disposed inside the housing 52, such that the spring biases the spray can 16 upwardly toward the teeth 172 to generate the biasing force 244.

Figure 16:
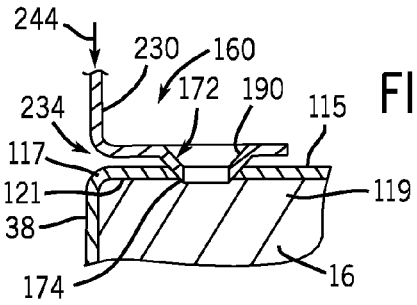
FIG. 16 is a partial schematic view of the grounding system in contact with the self-contained spray can, taken within line 16-16 of FIG. 15, illustrating an annular tooth piercing an exterior surface (e.g., insulative layer) on the top portion.

FIG. 16 is a partial schematic view of the grounding system in contact with the self-contained spray can 16, taken within line 16-16 of FIG. 15, illustrating an annular tooth 172 piercing the exterior surface 115 (e.g., insulative layer 117) on the top portion 234. As discussed in detail above with reference to FIGS. 11 and 14, the conductive element 160, 232 includes the tooth 172 having the hollow tapered portion 190 with the bore 192 leading to the sharp edge 174. As illustrated, the sharp edge 174 and the hollow tapered portion 190 of the tooth 172 extends into the exterior surface 115, extends completely through the insulative layer 117, and extends partially into the metal surface 121 of the metal wall 119. For example, the sharp edge 174 may create a slight surface cut along the metal surface 121 without puncturing the metal wall 119. In certain embodiments, the sharp edge 174 may partially cut into the metal wall 119 by less than approximately 5, 10, 15, or 20 percent of a thickness of the metal wall 119. In other embodiments, the sharp edge 174 may not cut into the metal wall 119, but rather the sharp edge 174 may deform the metal wall 119 due to the biasing force 244. In either embodiment, the tooth 172 is configured to make a positive electrical contact with the metal can to provide grounding for the electrostatic charging system.

Figure 17:
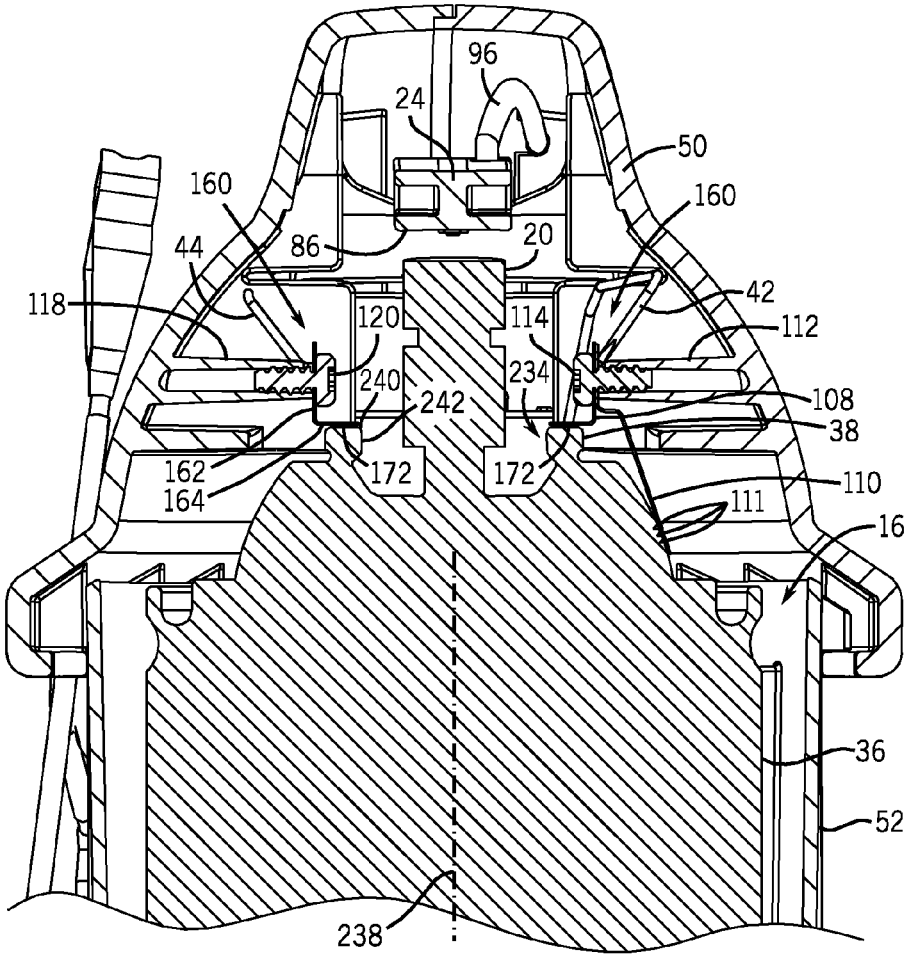
FIG. 17 is a cross-sectional view of the spray device, taken along line 5-5 of FIG. 2, illustrating the electrical contact between the spray device and the self-contained spray can.

FIG. 17 is a cross-sectional view of an embodiment of the spray device 12, taken along line 5-5 of FIG. 2, illustrating the electrical contact between the spray device 12 and the self-contained spray can 16. As previously discussed, both the neck 38 and the body 36 of the self-contained spray can 16 are electrically coupled to the earth ground 32. Specifically, the electrical conductor 40 extends between the body 36 of the spray can 16 and the earth ground 32, and the electrical conductor 42 extends between the neck 38 and the earth ground 32. As illustrated, the first and second conductive elements 160 (e.g., 230 and 232) contact the top portion 234 and/or the neck 36 of the spray can 16, while the third conductive element (e.g., the tab 110) contacts the neck 38 and/or the body 36 of the spray can 16. In certain embodiments, the conductive elements 110 and 160 are flexible and biased toward the spray can 16. Consequently, as the self-contained spray can 16 is inserted into the frame 50 of the spray device 12, the teeth 111 of the conductive element 110 and the teeth of the conductive elements 160 (e.g., 230 and 232) extend into the exterior surface 115, extend completely through the insulative layer 117, and extend partially into the metal surface 121 of the metal wall 119 of the spray can 16. As a result, the teeth 111 and 172 ensure positive electrical contact with the spray can 16, thereby ensuring grounding of the spray can 16 with the electrostatic charge system.

As illustrated in FIG. 17, the conductive elements 160 (e.g., 230 and 232) are coupled to the posts 112 and 118 with the fasteners 114 and 120. Each mounting portion 162 is oriented along the axis 238, whereas each tab portion 164 is oriented crosswise (e.g., perpendicular) to the axis 238. In other words, the tab portion 164 of each conductive element 160 extends radially inward toward the axis 238, such that the tab portion 164 overlaps the upper axial surface 240 along the lip or rim 242. As discussed above, the teeth 172 project outwardly from the tab portion 164 away from the mounting portion 162. In the illustrated embodiment, the teeth 172 extend along the axis 238 axially against the upper axial surface 240. Thus, the teeth 172 extend axially into the exterior surface 115, extend axially completely through the insulative layer 117, and extend axially into (or against) the metal surface 121 of the metal wall 119 of the spray can 16. In contrast, the teeth 111 of the conductive element 110 extend radially relative to the axis 238. Thus, the teeth 111 extend radially into the exterior surface 115, extend radially completely through the insulative layer 117, and extend radially into (or against) the metal surface 121 of the metal wall 119 of the spray can 16. Furthermore, after the can spray can 16 is inserted into the frame 50 of the spray device 12, the spray can 16 may be twisted along the axis 238 to further assist the teeth 111 and 172 in making electrical contact with the metal wall 119.

In the illustrated embodiment, the spray device 12 is configured to automatically switch the electrostatic charge system to an activated state based only on contact between the grounding system and the self-contained spray can 16, and the spray device 12 is configured to automatically switch the electrostatic charge system to a deactivated state based only on a lack of contact between the grounding system and the self-contained spray can 16. In other words, the spray device 12 may exclude a mechanical switch configured to activate or deactivate the electrostatic charge system based on the presence or absence of the spray can 16. Once activated, a user can operate the spray device 12 by pulling the trigger assembly 22.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A system, comprising:

a spray device, comprising:

a frame having a receptacle configured to receive a self-contained spray can;

a trigger assembly disposed within the frame and configured to selectively engage a spray of fluid from a spray nozzle of the self-contained spray can;

a grounding system comprising a first conductive element configured to contact the self-contained spray can, wherein the first conductive element comprises a first tooth configured to extend at least partially into an exterior surface of the self-contained spray can; and an electrostatic charge system coupled to the grounding system; and the self-contained spray can, wherein the exterior surface of the self-contained spray can comprises an insulative layer, and the first tooth is configured to extend completely through the insulative layer of the self-contained spray can to contact a metal wall of the self-contained spray can.

2. The system of claim 1, wherein the first tooth is configured to extend completely through an insulative layer of the self-contained spray can to contact a metal wall of the self-contained spray can.

3. The system of claim 1, wherein the spray device is configured to automatically switch the electrostatic charge system to an activated state based on contact between the grounding system and the self-contained spray can, and the spray device is configured to automatically switch the electrostatic charge system to a deactivated state based on a lack of contact between the grounding system and the self-contained spray can.

4. The system of claim 1, wherein the first tooth comprises a first sharp edge.

5. The system of claim 4, wherein the first tooth comprises a first annular tooth having the first sharp edge, and the first sharp edge comprises a first annular sharp edge.

6. The system of claim 1, wherein the first tooth is configured to extend at least partially into the exterior surface along a neck of the self-contained spray can.

7. The system of claim 1, comprising a second conductive element configured to contact the self-contained spray can, wherein the second conductive element comprises a second tooth configured to extend at least partially into the exterior surface of the self-contained spray can.

8. The system of claim 1, wherein the electrostatic charge system comprises a first electrical conductor extending between the first conductive element and an earth ground such that a first electrical potential of the self-contained spray can is substantially equal to a second electrical potential of the earth ground while the self-contained spray can is in contact with the first conductive element.

9. The system of claim 1, wherein the electrostatic charge system comprises an indirect charging electrode.

10. The system of claim 1, wherein the electrostatic charge system comprises a direct charging electrode.

11. The system of claim 1, wherein the electrostatic charge system comprises a charging electrode coupled to the trigger assembly.

12. The system of claim 1, wherein the electrostatic charge system comprises a battery configured to supply power to the electrostatic charge system.

* * * * *